US009496627B2

(12) United States Patent
Esmacher et al.

(10) Patent No.: US 9,496,627 B2
(45) Date of Patent: Nov. 15, 2016

(54) GROUNDING CONNECTOR

(71) Applicants: Matthew Esmacher, Mountclair, VA (US); Kian Chua, Fairfax, VA (US); Susitha Jayaratne, Rockville, MD (US)

(72) Inventors: Matthew Esmacher, Mountclair, VA (US); Kian Chua, Fairfax, VA (US); Susitha Jayaratne, Rockville, MD (US)

(73) Assignee: Washington Gas Light Company, Springfield, VA (US)

( * ) Notice: Subject to any disclaimer, the term of this patent is extended or adjusted under 35 U.S.C. 154(b) by 92 days.

(21) Appl. No.: 14/624,781

(22) Filed: Feb. 18, 2015

(65) Prior Publication Data

US 2015/0229043 A1 Aug. 13, 2015

Related U.S. Application Data

(63) Continuation of application No. 13/558,564, filed on Jul. 26, 2012, now Pat. No. 8,974,254.

(60) Provisional application No. 61/513,282, filed on Jul. 29, 2011.

(51) Int. Cl.

| | |
|---|---|
| ***H01R 4/32*** | (2006.01) |
| ***H01R 4/38*** | (2006.01) |
| *H01R 4/64* | (2006.01) |

(52) U.S. Cl.
CPC *H01R 4/32* (2013.01); *H01R 4/38* (2013.01); *H01R 4/64* (2013.01)

(58) Field of Classification Search
CPC ..... H01R 4/32
See application file for complete search history.

(56) References Cited

U.S. PATENT DOCUMENTS

| | | | |
|---|---|---|---|
| 2,187,166 | A | 1/1940 | Madden |
| 2,816,274 | A | 12/1957 | Barlow |
| 3,260,987 | A | 7/1966 | Gunthel |

(Continued)

FOREIGN PATENT DOCUMENTS

| | | |
|---|---|---|
| CH | 106 640 | 9/1924 |
| DE | 102009004937 | 8/2009 |

(Continued)

OTHER PUBLICATIONS

International Search Report mailed on Oct. 18, 2012, for PCT Application No. PCT/US2012/048287 (4 pages).

(Continued)

*Primary Examiner* — James Harvey
(74) *Attorney, Agent, or Firm* — Finnegan, Henderson, Farabow, Garrett & Dunner, L.L.P.

(57) ABSTRACT

Embodiments of the present disclosure include a connector. The connector may include a connection body and an engagement structure. The connection body may include a first support member, a second support member, a base from which the first support member and the second support member extend, wherein the base includes a beveled portion for connecting the connection body to the structure, and a slot defined between the first support member and the second support member and configured to receive a ground line. The engagement structure may be configured to engage the first support member and the second support member and move relative to the base along the first support member and the second support member.

20 Claims, 3 Drawing Sheets

(56) References Cited

U.S. PATENT DOCUMENTS

| | | | | |
|---|---|---|---|---|
| 3,552,257 | A | 1/1971 | Tanabe | |
| 4,106,832 | A | 8/1978 | Burns | |
| 4,147,446 | A | 4/1979 | Frank, Jr. | |
| 4,413,876 | A | 11/1983 | Borne et al. | |
| 4,650,274 | A | 3/1987 | Schmid | |
| 4,842,530 | A * | 6/1989 | Erickson, II | H01R 4/32 439/779 |
| 5,007,847 | A | 4/1991 | Dixon et al. | |
| 5,129,844 | A | 7/1992 | Goto et al. | |
| 5,236,377 | A * | 8/1993 | Goto | H01R 4/32 24/135 R |
| 5,336,113 | A | 8/1994 | Chanteau | |
| 5,480,311 | A | 1/1996 | Luu | |
| 5,487,685 | A | 1/1996 | Stillback et al. | |
| 5,823,804 | A * | 10/1998 | Auclair | H01R 4/646 439/52 |
| 5,928,006 | A * | 7/1999 | Franks, Jr. | H01R 4/36 439/443 |
| 7,008,244 | B2 | 3/2006 | Alladice | |
| 7,056,161 | B2 | 6/2006 | Delcourt et al. | |
| 7,083,479 | B2 | 8/2006 | Muller et al. | |
| 7,241,185 | B1 | 7/2007 | Cecil et al. | |
| 7,492,996 | B2 | 2/2009 | Kowalczyk et al. | |
| 7,566,250 | B1 | 7/2009 | Good | |
| 7,788,802 | B2 | 9/2010 | Schaty | |
| 8,277,263 | B1 | 10/2012 | Smith | |
| 2011/0237140 | A1 * | 9/2011 | Cerasale | H01R 4/36 439/797 |
| 2013/0078851 | A1 | 3/2013 | Esmacher | |

FOREIGN PATENT DOCUMENTS

| | | |
|---|---|---|
| DE | 102008056133 | 5/2010 |
| FR | 1 587 247 | 3/1970 |

OTHER PUBLICATIONS

Written Opinion of the International Searching Authority mailed on Oct. 18, 2012, for PCT Application No. PCT/US2012/048287 (5 pages).

* cited by examiner

GROUNDING CONNECTOR

CROSS-REFERENCE TO RELATED APPLICATION

This application is a continuation application of U.S. application Ser. No. 13/558,564, filed Jul. 26, 2012 (now U.S. Pat. No. 8,974,254), which claims the benefit of priority under 35 U.S.C. §119 to U.S. Provisional Patent Application No. 61/513,282, filed on Jul. 29, 2011, all of which are incorporated herein by reference in their entirety.

FIELD OF THE DISCLOSURE

Embodiments of the present disclosure include a grounding connector, and more particularly, a weldable grounding connector.

BACKGROUND OF THE DISCLOSURE

Generally, certain structures and equipment that are isolated from the ground may be electrically grounded to prevent damage caused by, for example, electrical surges, electric faults, and static charge build-up. Typically, a ground wire may be coupled to the structure to ground the structure. For example, a ground wire may be secured to a pipe by a strap, damp, or similar means. Straps, however, may not provide enough contact surface area to securely couple the grounding wire with the pipe. Moreover, inspections of the ground connection require that the straps be frequently disconnected and reconnected from the pipe, which may damage and weaken the strap. As a result, these damaged and weakened straps may fail when the pipe experiences electric surges.

Alternatively, the ground wire may be welded directly onto the pipe. Such a connection, however, may be cumbersome when testing the ground wire, as the ground wire must be regularly detached to verify the ground quality of the wire, and then rewelded. Furthermore, the weld may not provide enough surface area for connection due to the existence of air pockets within the weld. Welding may also be harmful to the pipe, as the wire may not be a suitable material to weld onto the pipe.

Accordingly, the grounding connector and related methods of the present disclosure are directed to improvements in the existing technology.

SUMMARY OF THE DISCLOSURE

In accordance with an embodiment, a connector for electrically grounding a structure may include a connection body and an engagement structure. The connection body may include a first support member, a second support member, a base from which the first support member and the second support member extend, wherein the base includes a beveled portion for connecting the connection body to the structure, and a slot defined between the first support member and the second support member and configured to receive a ground line. The engagement structure may be configured to engage the first support member and the second support member and move relative to the base along the first support member and the second support member.

In accordance with another embodiment, a connector for electrically grounding a structure may include a connection body and an engagement structure. The connection body may include a first support member, a second support member, a base from which the first support member and the second support member extend, wherein the base is configured to be coupled to the structure, and a slot defined between the first support member and the second support member and configured to receive a ground line, wherein the slot includes a substantially flat surface disposed on the base for contacting the ground wire. The engagement structure may be configured to engage the first support member and the second support member and move relative to the base along the first support member and the second support member.

In accordance with yet another embodiment, a connector for electrically grounding a structure may include a connection body and an engagement structure. The connection body may include a first support member, a second support member, a base configured to couple the connection body to the structure, wherein the first support member extends from the base at a first interface, and the second support member extends from the base at a second interface, and a slot defined between the first support member and the second support member and configured to receive a ground line, wherein the slot includes a surface for contacting the ground line, wherein the surface is disposed on a top end of the base and extends between the first interface and the second interface. The engagement structure may be configured to engage the first support member and the second support member and move relative to the base.

DETAILED DESCRIPTION

Reference will now be made in detail to exemplary embodiments of the present disclosure described above and illustrated in the accompanying drawings. Wherever possible, the same reference numbers will be used throughout the drawings to refer to the same or like parts.

The following detailed description illustrates a grounding connector by way of example and not by way of limitation. Although the description below describes an application of a grounding connector for grounding a pipe, and particularly a natural gas pipe, embodiments of the disclosed grounding connector may be applied to electrically couple components in any application, including, without limitation, for grounding purposes. For example, embodiments of the current disclosure may be used to ground electrical components in a building, computer components, and engine and/or motor components.

Figure 1:
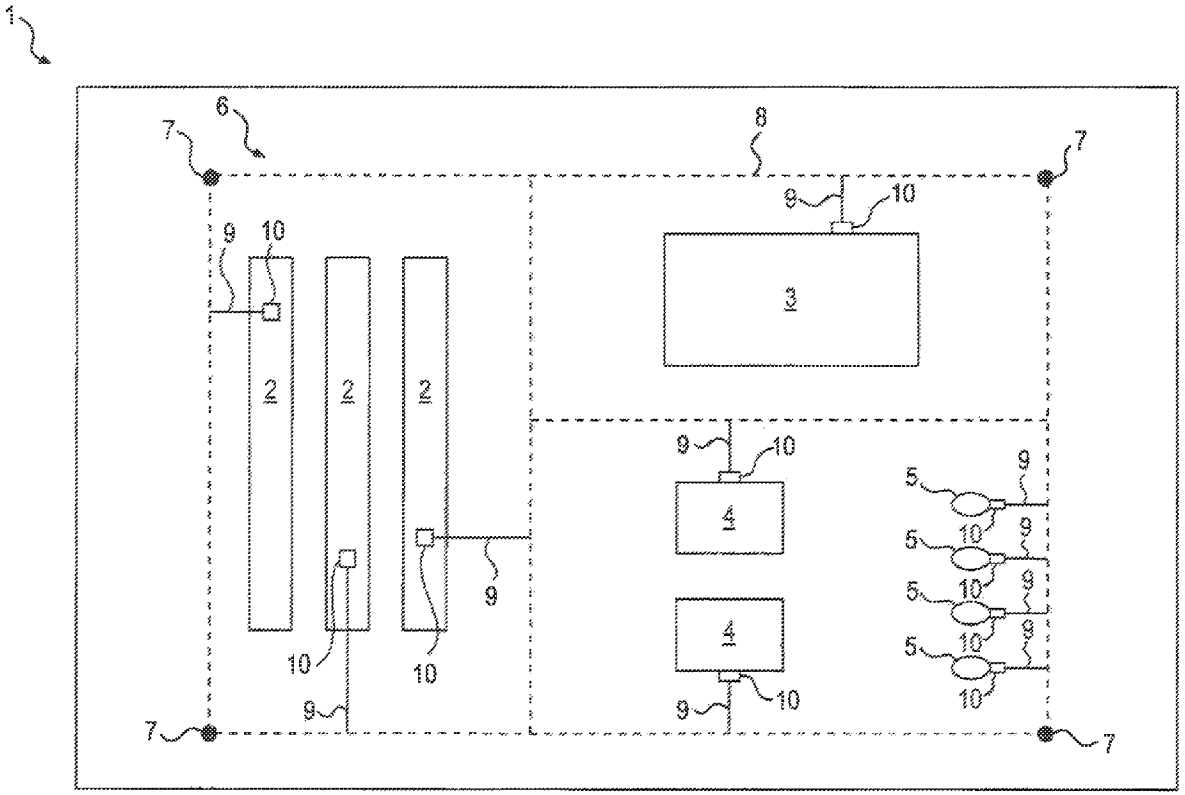
FIG. 1 is a schematic illustration of a facility employing a grounding connector, according to an exemplary disclosed embodiment.

FIG. 1 is a schematic illustration of a facility 1, according to an exemplary disclosed embodiment. In some embodiments, facility 1 may be a natural gas facility for storing and/or processing natural gas. Natural gas facility 1 may include a system of above-ground pipes 2 for carrying and delivering natural gas and a control center 3 for monitoring and controlling the natural gas within pipes 2. It should be appreciated that natural gas facility 1 may also include any other suitable structures, such as, for example, one or more generators 4, electrical meters 5, and electric utility lines (not shown).

Natural gas facility 1 may also include a grounding system 6 configured to electrically ground the various structures of natural gas facility 1 and prevent damage caused by, for example, electrical surges, electrical faults, and/or static charge build-up. Grounding system 6 may include one or more conductive rods 7, such as, for example, a copper stake, dug into the ground. Grounding system 6 may also include a conductive grid 8 comprised of a plurality of conductive lines, such as, for example, copper cables, surrounding the structures of natural gas facility 1 and in electrical communication with conductive rods 7 (and thus the ground). In some embodiments, conductive grid 8 may be dug underground. One or more ground lines 9 may be electrically connected to conductive grid 8 and/or conductive rods 7, and may be coupled to the structures of natural gas facility 1 to ground the structures. For example, ground ones 9 may be coupled to pipes 2 and electrically-conductive components of control center 9, generator 4, and meters 5 for grounding purposes. Ground lines 9 may include any suitable conductive material, such as, for example, copper and/or stainless steel wires, cables, rods, or the like.

Ground lines 9 may be coupled to pipes 2 and any other structures via a grounding connector 10. As will be described in more detail below, grounding connector 10 may be suitably connectable to, for example, pipe 2, and may be configured to electrically couple and decouple ground lines 9 to pipe 2 to ground pipe 2.

Figure 2:
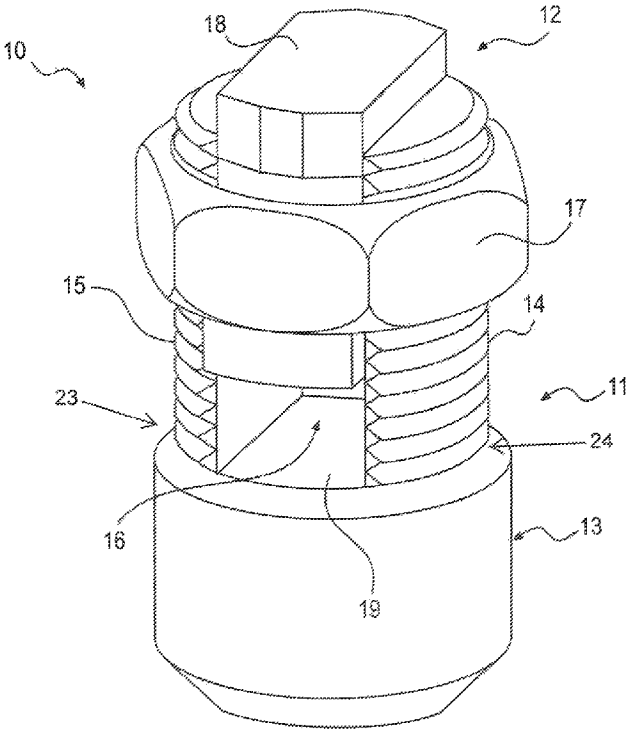
FIG. 2 illustrates a perspective view of a grounding connector, according to an exemplary disclosed embodiment.

FIG. 2 is a perspective illustration of grounding connector 10, according to an exemplary disclosed embodiment. As shown in FIG. 2, grounding connector 10 may include a connection body 11 and an engagement structure 12.

Connection body 11 may include a base 13, a first support member 14 extending from base 13, and a second support member 15 extending from base 13. A slot 16 may be defined between first support member 14 and second support member 15 through which ground line 9 may be disposed. First support member 14 and second support member 15 may include a threaded configuration configured to mate with complementary grooves of engagement structure 12. For example, in certain embodiments, engagement structure 12 may include a nut 17 and a contact member 18. Nut 17 may engage first and second support members 14, 15, and contact member 18 may be movably disposed within slot 16. Nut 17 may be screwed towards base 13 to secure ground line 9 between contact member 18 and base 13, and may be screwed away from base 13 to disengage ground line 9 from contact member 18 and base 13. Nut 17 and contact member 18 may be formed of any suitable malleable and conductive material, including, as examples, copper and bronze. Accordingly, if connection body 11 is exposed to excessive stress on or near engagement structure 12, engagement structure 12 may prevent damage to base 13 and first and second support members 14, 15 by absorbing the stress before such stress damages base 13 and first and second support members 14, 15. Although engagement structure 12 may engage first and second support members 14, 15 via a screw-like arrangement, it should be appreciated that any other suitable configuration may be employed to removably couple engagement structure 12 to first and second support members 14, 15. Such configurations may include, as examples, a friction fit arrangement and removable fasteners. In certain embodiments, first and second support members 14, 15 may each include a height of approximately one inch, and slot 16 may include a width of approximately 0.44 inches. It should be appreciated, however, that first and second support members 14, 15 and slot 16 may include any suitable dimensions to provide appropriate grounding of a structure and may depend on, for example, the size of ground line 9 and/or pipe 2.

Slot 16 may also include a substantially flat surface 19. Ground line 9 may be electrically coupled to grounding connector 10 by contacting flat surface 19. Flat surface 19 may also provide improved contact and compression of ground line 9 to grounding connector 10. For example, in certain applications, ground line 9 may be composed of multiple conductive structures, such as multiple conductive wires, cables, rods, and the like, and may be disposed through slot 16. As engagement structure 12 is moved towards base 13, contact member 18 may contact and compress the multiple conductive structures of ground line 9 against flat surface 19. The conductive structures may spread apart across flat surface 19. The flat configuration of surface 19 may provide a level surface area for the conductive structures to spread out, which may provide increased contact with base 13 and improved compression and connection of the conductive structures by engagement structure 12. Rat surface 19 may also provide more versatility for supporting and connecting other flat-shaped materials, such as, for example, flange guards, to grounding connector 10.

Flat surface 19 may also be positioned at a top end of base 13 and may be substantially perpendicular to first and second support members 14, 15. That is, flat surface 19 may extend across a first interface 23 between first support member 14 and base 13 and a second interface 24 between second support member 15 and base 13. The entire exterior surface of base 13 may also extend up to the first interface 23 and the second interface 24. As such, base 13 may be a solid, substantially cylinder-shaped structure, which may provide a stronger connection to pipe 2.

Connection body 11 may also be formed of any suitable material that is electrically conductive and compatible with the material of pipe 2, or any other structure, for welding and/or fastening purposes. The material may be, for example, stainless steel (generally the same material as pipe 2), to provide appropriate grounding of pipe 2 and corrosion resistance, and to allow grounding connector 10 to be directly welded and/or fastened to pipe 2.

Figure 3:
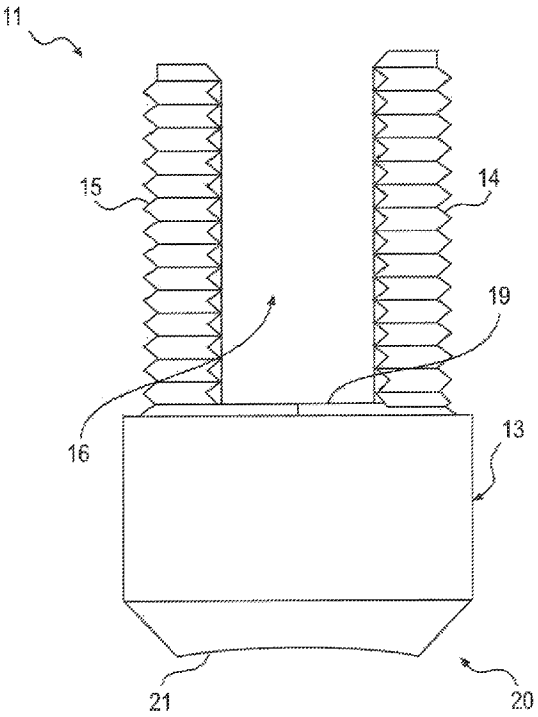
FIG. 3 illustrates a perspective view of a connection body of the grounding connector of FIG. 2, according to an exemplary disclosed embodiment.

FIG. 3 illustrates a perspective illustration of connection body 11, according to an exemplary disclosed embodiment. As show in FIG. 3, base 13 may include a beveled portion 20 configured to facilitate the connection of grounding connector 10 to a structure, such as pipe 2.

Beveled portion 20 may define a recessed space at a bottom end of base 13 to allow a greater amount of fastening material, such as, for example, adhesives, solder, welds, and the like, to be positioned between grounding connector 10 and pipe 2. Beveled portion 20 therefore may promote a stronger bond between grounding connector 10 and pipe 2. In certain embodiments, beveled portion 20 may include a tapered configuration to define the recessed space. That is, the diameter of base 13 beginning at beveled portion 20 may incrementally decrease towards a terminal end 21 of base 13.

Terminal end 21 may be positioned at the bottom of base 13, and may be configured to complement the surface of the structure onto which grounding connector 10 may be connected. In certain embodiments, for example, terminal end 21 may include a curved shape to complement the curved configuration of pipe 2. Accordingly, terminal end 21 may provide improved mating, and thus bonding, between grounding connector 10 and pipe 2. It should be appreciated, however, that terminal end 21 may include any other suitable shape configured to complement the mating between grounding connector 10 and any other structure. For example, in some embodiments, terminal end 21 may include a substantially flat surface to complement a flat surface of a structure onto which grounding connector 10 may be connected.

Grounding connector 10 is a separate unit that may be retrofitted to existing structures, such as pipe 2. In other words, grounding connector 10 is not integrally formed with a structure, such as pipe 2, and may be connected to any suitable structure by fastening and/or welding base 13 to the structure. Accordingly, the non-integral feature of grounding connector 10 may provide increased versatility and applicability for positioning and installing grounding connector 10 to a variety of structures.

Figure 4:
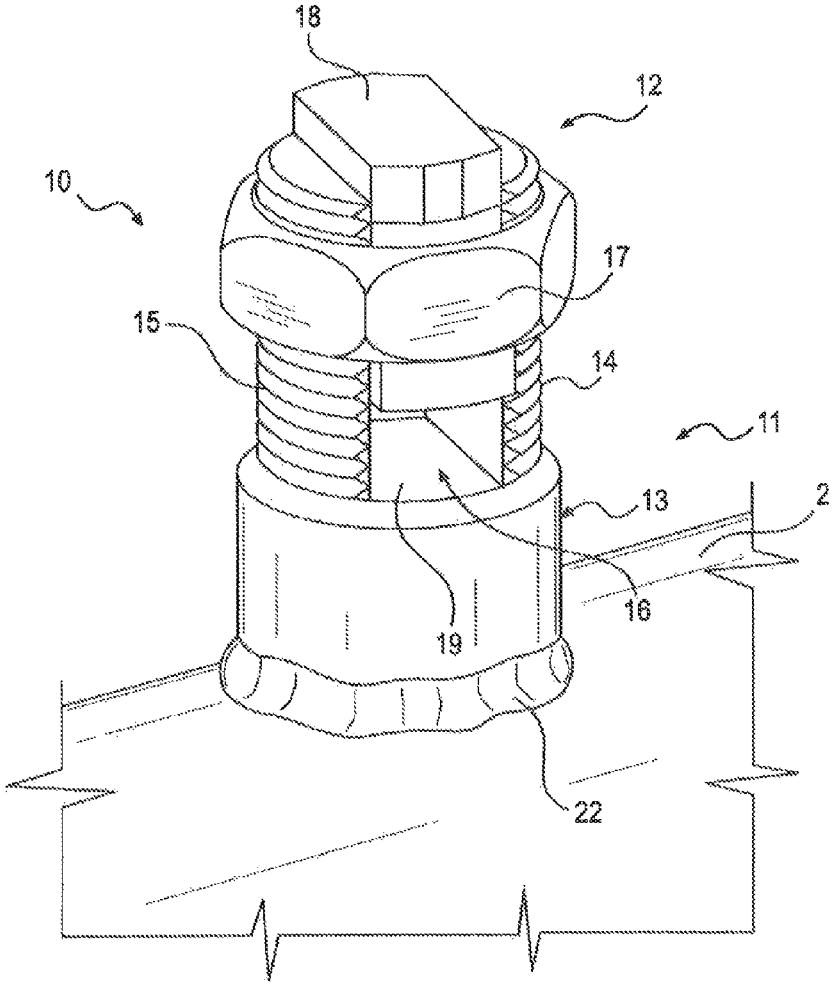
FIG. 4 illustrates a perspective view of the grounding connector of FIG. 2 coupled to a pipe, according to an exemplary disclosed embodiment.

FIG. 4 is a perspective illustration of grounding connector 10 connected to pipe 2, according to an exemplary disclosed embodiment. As alluded to above, a fastening material 22 may bond base 13 to pipe 2. Due to the non-integral nature of grounding connector 10, grounding connector 10 may be quickly coupled to pipe 2 by simply applying fastening material 22 between base 13 and pipe 2. Moreover, grounding connector 10 may be coupled to pipe 2 at any location of pipe 2 and at any orientation. For example, and as shown in FIG. 4, grounding connector 10 may be coupled to pipe 2 such that slot 16 substantially intersects a longitudinal axis of pipe 2. It should be appreciated, however, that grounding connector 10 may be coupled to pipe 2 such that slot 16 may be orientated in any other suitable direction, such as, for example, substantially parallel with the longitudinal axis of pipe 2. As such, grounding connector 10 may provide a versatile grounding structure to connect and accommodate ground lines 9 traveling in any direction.

Any aspect set forth in any embodiment may be used with any other embodiment set forth herein, it will be apparent to those skilled in the art that various modifications and variations can be made in the disclosed devices and processes without departing from the scope of the disclosure. Other embodiments of the disclosure will be apparent to those skilled in the art from consideration of the specification and practice of the disclosure disclosed herein. It is intended that the specification and examples be considered as exemplary only.

What is claimed is:

1. A connector for electrically grounding a structure, the connector comprising:
- a connection body including:
  - a first support member;
  - a second support member;
  - a base from which the first support member and the second support member extend,
  - wherein the connection body includes a terminal end for connecting to the structure, wherein the terminal end includes a concave surface; and
  - a slot defined between the first support member and the second support member and configured to receive a ground line; and
- an engagement structure configured to engage the first support member and the second support member.

2. The connector of claim 1, wherein the concave surface of the terminal end is configured to complement a surface of the structure onto which the connector is connected.

3. The connector of claim 1, wherein the base includes a beveled portion extending to the terminal end of the connection body.

4. The connector of claim 3, wherein the beveled portion defines a recessed space of the base.

5. The connector of claim 1, wherein the slot includes a substantially flat surface disposed on a top end of the base for contacting the ground line.

6. The connector of claim 1, wherein the first support member extends from the base at a first interface, and the second support member extends from the base at a second interface, and the flat surface extends between the first interface and the second interface.

7. The connector of claim 5, wherein an entire exterior surface of the base extends up to the first and second interfaces.

8. The connector of claim 1, wherein the base includes a substantially cylinder-shaped portion.

9. The connector of claim 8, wherein the substantially cylinder-shaped portion extends from a beveled portion of the base to the slot.

10. The connector of claim 1, wherein the connection body is formed of an electrically-conductive material.

11. A connector for electrically grounding a structure, the connector comprising:
- a connection body including:
  - a first support member;
  - a second support member;
  - a base from which the first support member and the second support member extend,
  - wherein the connection body includes a terminal end for connecting to the structure, wherein the terminal end includes a concave surface; and
  - a slot defined between the first support member and the second support member and configured to receive a ground one, wherein the slot includes a substantially fiat surface disposed on the base for contacting the ground line; and
- an engagement structure configured to engage the first support member and the second support member.

12. The connector of claim 11, wherein the flat surface is disposed on a top end of the base.

13. The connector of claim 11, wherein the flat surface is substantially perpendicular to the first and second support members.

14. The connector of claim 11, wherein the concave surface of the terminal end is configured to complement a surface of the structure onto which the connector is connected.

15. The connector of claim 11, wherein the base includes a beveled portion extending to the terminal end of the connection body.

16. The connector of claim 15, wherein the beveled portion defines a recessed space of the base.

17. A connector for electrically grounding a structure, the connector comprising:
- a connection body including:
  - a first support member;
  - a second support member;
  - a base, wherein the first support member extends from the base at a first interface, and the second support member extends from the base at a second interface,
  - wherein the connection body includes a terminal end for connecting to the structure, wherein the terminal end includes a concave surface; and
  - a slot defined between the first support member and the second support member and configured to receive a ground line, wherein the slot includes a surface for contacting the ground line, wherein the surface is disposed on a top end of the base and extends between the first interface and the second interface.

18. The connector of claim 17, wherein the concave surface of the terminal end is configured to complement a surface of the structure onto which the connector is connected.

19. The connector of claim 17, wherein the base includes a beveled portion extending to the terminal end of the connection body.

20. The connector of claim 17, further comprising an engagement structure configured to engage the first support member and the second support member and move relative to the base.

* * * * *